United States Patent [19]

Gee

[11] Patent Number: 4,517,724

[45] Date of Patent: May 21, 1985

[54] SEAMING TOOL

[76] Inventor: Elmer M. Gee, 2381 23rd St., Wyandotte, Mich. 48192

[21] Appl. No.: 512,393

[22] Filed: Jul. 11, 1983

[51] Int. Cl.[3] ..... B25B 27/02

[52] U.S. Cl. ..... 29/275

[58] Field of Search ..... 29/243.58, 243.57, 243.5, 29/254, 275; 173/133; 81/463

[56] References Cited

U.S. PATENT DOCUMENTS

| | | | |
|---|---|---|---|
| 1,963,306 | 6/1934 | Maynard | 29/243.57 |
| 2,233,937 | 3/1941 | Hexdall | 29/243.5 |
| 2,897,504 | 8/1959 | Shapiro | 29/243.58 X |
| 3,188,729 | 6/1965 | Pogue, Jr. et al. | 29/243.58 |
| 4,318,211 | 3/1982 | Hoskinson | 29/243.58 X |

*Primary Examiner*—Frederick R. Schmidt
*Assistant Examiner*—Steven P. Schad
*Attorney, Agent, or Firm*—Harness, Dickey & Pierce

[57] ABSTRACT

A tool useful for assembling metal panels and particularly for forming a seam for air circulating ducts wherein a first panel forms a bent flange and a second panel forms a flange receiving channel. The tool includes a guide member having surfaces which contact each of the panels thus positioning a driving lever which when struck, forces the first panel into the second panel channel. A first embodiment is disclosed useful for seaming panels along straight edges and a second embodiment is disclosed useful for seaming panels in corners.

4 Claims, 4 Drawing Figures

SEAMING TOOL

BACKGROUND AND SUMMARY OF THE INVENTION

This invention relates to a tool and method for seaming interlocking metal panels, and more specifically to a tool and method useable in the fabrication of air circulating ducts and other structures for forcing a bent metal flange of a first panel within a channel formed by a second panel. Typically such joints are used to seam together ducts wherein the panels to be attached are adjacent duct sides which are formed by bending flat sheet stock. Assembly of such ducts is accomplished according to the prior art by striking the surface of the first panel with a hammer near the flange thereby driving the flange into the channel of the second panel. The seam is secured when the upstanding flange of the second panel is bent over the first panel thus forming an interlocking joint. Optimally, the hammer impact should occur along the corner of the first panel formed by the flange, thus inserting the flange securely within the channel. Use of conventional hammers for driving the panels together, however, leads to construction flaws since hammer blows cannot be precisely aimed and the hammer striking surface is not tailored to this specific application. If the hammer strikes the panel surface any appreciable distance from the flange, denting of the typically thin gauge sheet metal is likely. On the other hand, if the hammer strikes the joint itself damage to the upstanding flange is likely. Moreover, even a precisely aimed hammer blow can cause panel damage. For these reasons, assembly using conventional hammers to seam the panels is time consuming and often results in poor appearance of the finished product.

In accordance with this invention, an improved duct seaming tool and method is disclosed which overcomes the shortcomings of the prior art as described above. The improved seaming tool accurately positions an anvil near the panel flange. By striking the tool with a conventional hammer, the impact force is directed to the duct joint thereby preventing panel damage since other panel areas are not impacted. Additionally, since the tool directs the hammer impact force accurately, less effort is necessary and fewer blows are required to join the panels and a more secure joint is formed. The tool according to this invention further allows rapid fabrication even by inexperienced personnel.

Additional benefits and advantages of the present invention will become apparent to those skilled in the art to which this invention relates upon a reading of the description of the described preferred embodiments of this invention taken in conjunction with accompanying drawings.

DETAILED DESCRIPTION OF THE INVENTION

Figure 1:
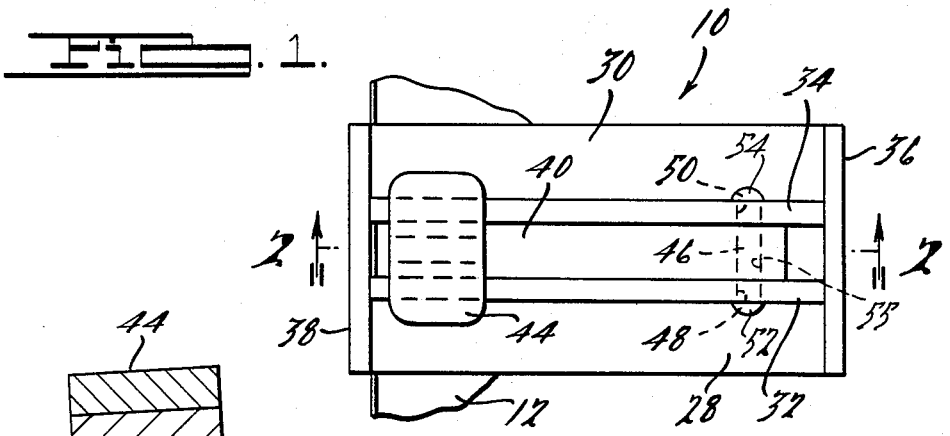
FIG. 1 is a plan view of a first embodiment of this invention shown with the associated metal panels.
Figure 2:
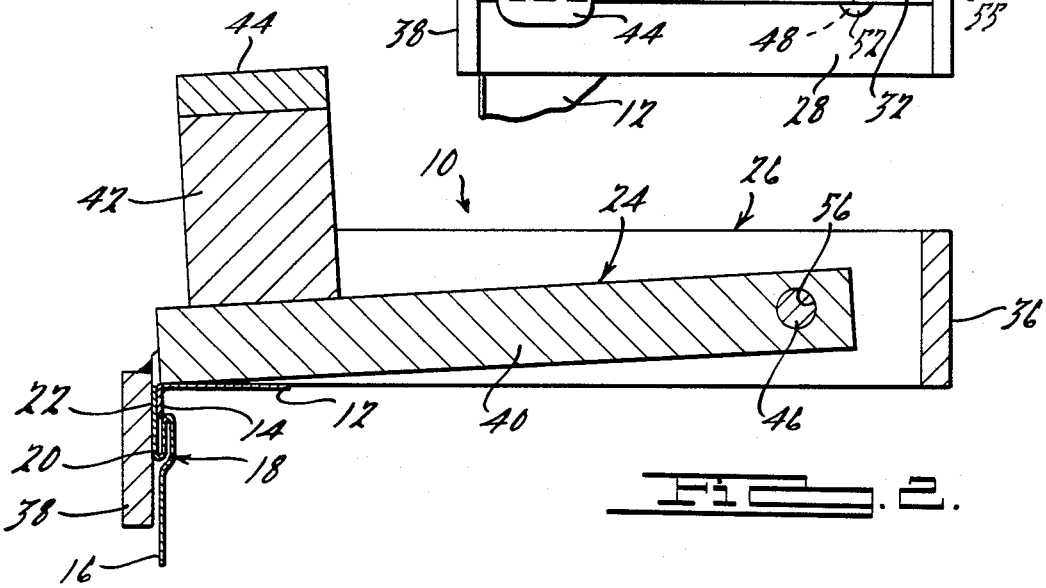
FIG. 2 is a sectional view taken along line 2—2 of FIG. 1 showing the associated panels in an initial, unassembled position.
Figure 3:
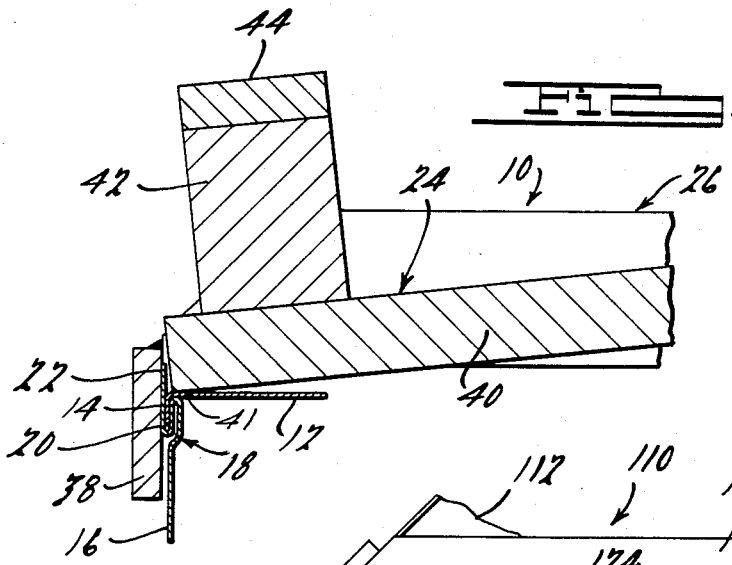
FIG. 3 is a partial sectional view taken along line 2—2 of FIG. 1 showing the associated panels in an assembled position.

With particular reference to FIGS. 1 and 2, an improved duct seaming tool, generally designated by reference character 10 is shown for use in conjunction with the duct seaming system shown best illustrated by FIG. 2. First panel 12 includes flange 14 forming a right angle with the major surface of first panel 12. Second panel 16 forms an "S" shaped bent portion 18 having flange receiving channel 20 and upstanding flange 22. Channel 20 is dimensioned to closely receive flange 14. FIG. 3 depicts panels 12 and 16 in an assembled position with flange 14 fitting within channel 20.

Seaming tool 10 includes two principal components, driving lever 24 and guide assembly 26. Guide assembly 26 is formed from bottom plate members 28 and 30, center plates 32 and 34, end plate 36 and guide plate 38. Bottom plate members 28 and 30 are welded to center plates 32 and 34 or are integral therewith by employing angle iron stock. End plate 36 and guide plate 38 are welded or otherwise attached to the ends of plates 28, 30, 32, and 34 such that center plates 32 and 34 define an open channel. Guide plate 38 extends below the plane defined by bottom plates 28 and 30. The angle formed between bottom plate members 28 and 30 and guide plate 38 is equivalent to the angle between panels 12 and 16 which in the case of the illustrated preferred embodiments is a right angle.

Driver lever 24 is formed from anvil member 40, upright plate 42 and striking head 44. Anvil member 40 has a width dimension less than the width dimension of the open channel formed by center plates 32 and 34 such that the anvil may be moved within the channel. Upright plate 42, which is affixed to anvil member 40 similarly has a lateral dimension less than the width between center plates 32 and 34 thereby permitting movement with anvil member 40 within the channel. Attached to upright plate 42 is striking head 44. Anvil member 40 includes striking portion 41 which contacts panel 12. Anvil member 40 is affixed to guide assembly 26 by pin 46 which pivotally affixes anvil member 40 to center plates 32 and 34. Pin 46 fits within bores 48 and 50 within plates 32 and 34 respectively and is held in position by peaned heads 52 and 54. Relative rotation between anvil member 40 and guide assembly 26 is permitted by providing loose fitting bore 56 within anvil member 40.

Figure 4:
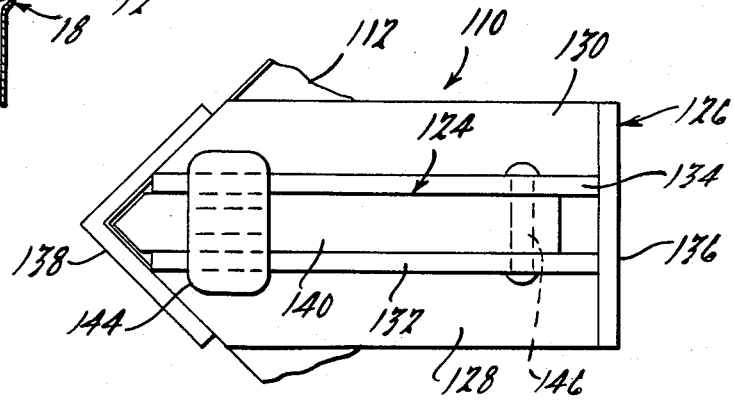
FIG. 4 is a plan view of a second embodiment of this invention illustrating a tool particularly adapted for use where panel sides joint to form three mutually perpendicular surfaces.

A second embodiment of this invention is illustrated by FIG. 4. This embodiment differs from the first in that it is particularly adapted to drive panels together where panels form three mutually perpendicular surfaces as occurs at the corner of a cube. Elements of this embodiment which perform a similar function as those of the first embodiment are designated by the element numbers associated with the first embodiment to which 100 is added. Duct seaming tool 110 employs guide plate 138 which forms two right angle planes each being perpendicular to the plane defined by bottom plates 128 and 130. In addition, anvil member 140 forms striking portion 141 which forms right angle surfaces as viewed by FIG. 4. Otherwise, the seaming tool according to this second embodiment is configured as described above in connection with the first embodiment.

In operation, metal panels 12 and 16 of a duct or other structure are brought together to the position shown by FIG. 2 such that flange 14 is located at the opening of channel 20. Panel seaming tool 10 is brought into position with respect to panels 12 and 16 by placing guide assembly 26 on panel 12 and then manually grasping the tool and moving it to the right with respect to the orientation of components illustrated by FIGS. 2 and 3 until guide plate 38 contacts panel 16. In this position, striking portion 41 of anvil member 40 contacts panel 12 at near the break line between panel 12 and flange 14. By striking head 44 downwardly with a conventional hammer, flange 14 is driven into channel 20 as shown in FIG. 3. Once the panels are joined at a given location, seaming tool 10 is moved to a new position along the duct seam between panels 12 and 16. Use of seaming tool 10 enables the user to assemble panels quickly, with minimum effort and without damaging the panels.

Use of seaming tool 110 proceeds by locating the tool such that guide plate 138 fits on the outside of a corner of the structure being assembled. Otherwise, operation of tool 110 proceeds as described above in connection with tool 10. Optionally, one contructing air circulation ducts or other metal structures would employ both the tools described using a tool according to the first embodiment for straight seam sections and using a tool according to the second embodiments for the corners where three perpendicular panel surfaces join.

Following the use of tools 10 and/or 110 the tool is removed from the structure and upstanding flange 22 is bent onto panel 12 using a conventional hammer or other tool thereby creating an interlocking connection between the panels.

While preferred embodiments of the invention have been described herein, it will be appreciated that various modifications and changes may be made without departing from the spirit and scope of the appended claims.

I claim:

1. A tool for seaming together sheet metal panels wherein a first panel includes a flange forming a right angle with respect to said first panel and a second panel forming a flange receiving channel, said first and second panels oriented at right angles to one another when assembled, said tool comprising, a guide member forming a bottom surface and forming an open channel extending between a first and second end of said guide member, said guide member having a guide plate located at said first end, said guide plate oriented at a right angle with respect to said bottom surface and extending laterally away from said guide member, an elongated driving lever having a first and second end and having an upright plate located near said first lever end and a striking head attached to said upright plate, and pivot means pivotably supporting said driving lever at said second end of said driving lever said driving lever pivotably movable within said channel such that when said guide member bottom surface is brought into contact with said first panel and said guide plate contacts said second panel, a force applied to said striking head is transmitted to said flange through contact therewith causing said first panel flange to be forced into said second panel channel.

2. A tool according to claim 1 wherein said guide member guide plate is substantially flat.

3. The tool according to claim 1 wherein said first and second panels form sides of an air circulating duct whereby said tool is useable for forming an interlocking duct seam.

4. The tool according to claim 1 wherein said guide member guide plate forms two surfaces oriented at right angles to one another and wherein said driving lever having a pointed first end, said tool is useful for forcing said flange into said channel where said second panel forms two perpendicular surfaces.

* * * * *